US012685910B2

(12) United States Patent
Maeda et al.

(10) Patent No.: US 12,685,910 B2
(45) Date of Patent: Jul. 21, 2026

(54) GOLF CLUB AND WEIGHT PIECE FOR GOLF CLUB

(71) Applicant: SUMITOMO RUBBER INDUSTRIES, LTD., Hyogo (JP)

(72) Inventors: Kota Maeda, Hyogo (JP); Hiroshi Hasegawa, Hyogo (JP); Akihiko Kobayashi, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 64 days.

(21) Appl. No.: 18/960,588

(22) Filed: Nov. 26, 2024

(65) Prior Publication Data

US 2025/0083003 A1 Mar. 13, 2025

Related U.S. Application Data

(63) Continuation of application No. 17/567,233, filed on Jan. 3, 2022, now Pat. No. 12,179,074.

(30) Foreign Application Priority Data

Jan. 18, 2021 (JP) ..... 2021-005975

(51) Int. Cl.
*A63B 53/08* (2015.01)
*A63B 53/04* (2015.01)
(Continued)

(52) U.S. Cl.
CPC ..... *A63B 53/08* (2013.01); *A63B 53/0466* (2013.01); *A63B 53/047* (2013.01);
(Continued)

(58) Field of Classification Search
CPC ..... A63B 53/14; A63B 53/08; F16B 7/02
See application file for complete search history.

(56) References Cited

U.S. PATENT DOCUMENTS 5,145,171 A * 9/1992 Head ..... A63B 60/16 473/549
7,909,705 B2 * 3/2011 Gill ..... A63B 49/08 473/297
8,870,676 B2 * 10/2014 Takeuchi ..... A63B 60/24 473/297
9,452,333 B1 * 9/2016 Chalifoux ..... A63B 53/14
(Continued)

FOREIGN PATENT DOCUMENTS

JP 6601584 11/2019
KR 2012000365 U * 1/2012 ..... A63B 60/06

*Primary Examiner* — Joshua T Kennedy
(74) *Attorney, Agent, or Firm* — Greenblum & Bernstein, P.L.C.

(57) ABSTRACT

A golf club includes a club shaft having a first end, a second end, and an inner peripheral surface defining an inner space of the club shaft, and a weight piece installed on a first end side of the club shaft. The weight piece includes an insertion portion located in the inner space, and an engagement portion located outside the club shaft to engage the first end. The insertion portion includes a first portion and a second portion. The first portion has an outer diameter smaller than the first inner diameter. The second portion includes a large diameter portion having an outer diameter larger than the first inner diameter in a state before being placed in the club shaft, and at least one rigidity-lowered portion that elastically deforms the second portion so that the outer diameter of the large diameter portion becomes smaller when receiving an external force.

14 Claims, 9 Drawing Sheets

(51) Int. Cl.

| | |
|---|---|
| ***A63B 53/14*** | (2015.01) |
| ***A63B 60/02*** | (2015.01) |
| ***A63B 60/08*** | (2015.01) |
| ***A63B 60/14*** | (2015.01) |
| ***A63B 60/16*** | (2015.01) |
| ***A63B 60/24*** | (2015.01) |
| ***A63B 60/42*** | (2015.01) |
| ***A63B 60/50*** | (2015.01) |
| *A63B 60/54* | (2015.01) |

(52) U.S. Cl.

CPC ..... *A63B 53/0487* (2013.01); *A63B 53/14* (2013.01); *A63B 60/02* (2015.10); *A63B 60/08* (2015.10); *A63B 60/14* (2015.10); *A63B 60/16* (2015.10); *A63B 60/24* (2015.10); *A63B 60/42* (2015.10); *A63B 60/50* (2015.10); *A63B 60/54* (2015.10)

(56) References Cited

U.S. PATENT DOCUMENTS

| | | | | |
|---|---|---|---|---|
| 9,616,307 | B1 | 4/2017 | Chiang | |
| 10,010,773 | B1 | 7/2018 | Pugliese | |
| 2003/0207720 | A1 | 11/2003 | Sery | |
| 2010/0304882 | A1* | 12/2010 | Gill ..... | A63B 60/10 473/297 |
| 2011/0124431 | A1 | 5/2011 | Karube | |
| 2011/0256949 | A1 | 10/2011 | Soracco | |
| 2015/0360101 | A1 | 12/2015 | Solhaug | |
| 2016/0016057 | A1 | 1/2016 | Wang | |
| 2017/0182389 | A1 | 6/2017 | Golden | |
| 2017/0304697 | A1* | 10/2017 | Chalifoux ..... | A63B 60/14 |
| 2018/0361214 | A1 | 12/2018 | Johnson | |
| 2020/0338408 | A1 | 10/2020 | Takeuchi | |
| 2021/0154544 | A1 | 5/2021 | Milleman | |
| 2022/0226704 | A1 | 7/2022 | Maeda | |
| 2023/0057922 | A1 | 2/2023 | Johnston | |

* cited by examiner

GOLF CLUB AND WEIGHT PIECE FOR GOLF CLUB

CROSS-REFERENCE TO RELATED APPLICATIONS

This application is a Continuation of U.S. patent application Ser. No. 17/567,233 filed Jan. 3, 2022, which claims the benefit of Japanese Patent Application No. 2021-005975, filed Jan. 18, 2021. The contents of these applications are incorporated herein by reference in their entirety.

FIELD OF THE INVENTION

The present disclosure relates to a golf club and a weight piece for golf club.

BACKGROUND OF THE INVENTION

Golf club balance may impact golf swing of golfers. Golf club balance that fits golfers is different according to the ability of individual golfers. Thus, it would be convenient if the club balance could be easily adjusted.

In order to adjust the club balance of a golf club, the following Patent document 1, for example, discloses installing a weight member in a club shaft on the grip end side.

PATENT DOCUMENT

[Patent document 1] Japanese Patent 6601584

SUMMARY OF THE INVENTION

When manufacturing a golf club as described above, the weight piece is inserted into an inner space of the club shaft. To facilitate this insertion process, the outer diameter of the weight piece should be formed smaller than the inner diameter of the club shaft.

On the other hand, when the outer diameter of the weight piece is smaller than the club shaft, a gap between the weight piece and the club shaft will cause problems such as misalignment of the weight piece and rattling noise.

The present disclosure has been made in view of the above circumstances and has a major object to provide a golf club and a weight piece for golf club capable of suppressing misalignment and rattling noise of the weight piece while facilitating the process of inserting the weight piece into a club shaft.

In one aspect of the present disclosure, a golf club includes a tubular club shaft having a first end with a first inner diameter, a second end, and an inner peripheral surface defining an inner space of the club shaft, a weight piece installed on a first end side of the club shaft, and a golf club head mounted on a second end side of the club shaft. The weight piece includes an insertion portion located in the inner space of the club shaft, and an engagement portion located outside the inner space of the club shaft to engage the first end of the club shaft. The insertion portion includes a first portion on a first end side, and a second portion on a second end side. The first portion has an outer diameter smaller than the first inner diameter. The second portion includes a large diameter portion having an outer diameter larger than the first inner diameter in a state before being placed in the club shaft, and at least one rigidity-lowered portion that elastically deforms the second portion so that the outer diameter of the large diameter portion becomes smaller when receiving an external force. The second portion is placed in the inner space in an elastically deformed state so that the large diameter portion is at least partially in contact with the inner peripheral surface of the club shaft due to its elastic restoring force.

DETAILED DESCRIPTION OF THE INVENTION

Figure 1:
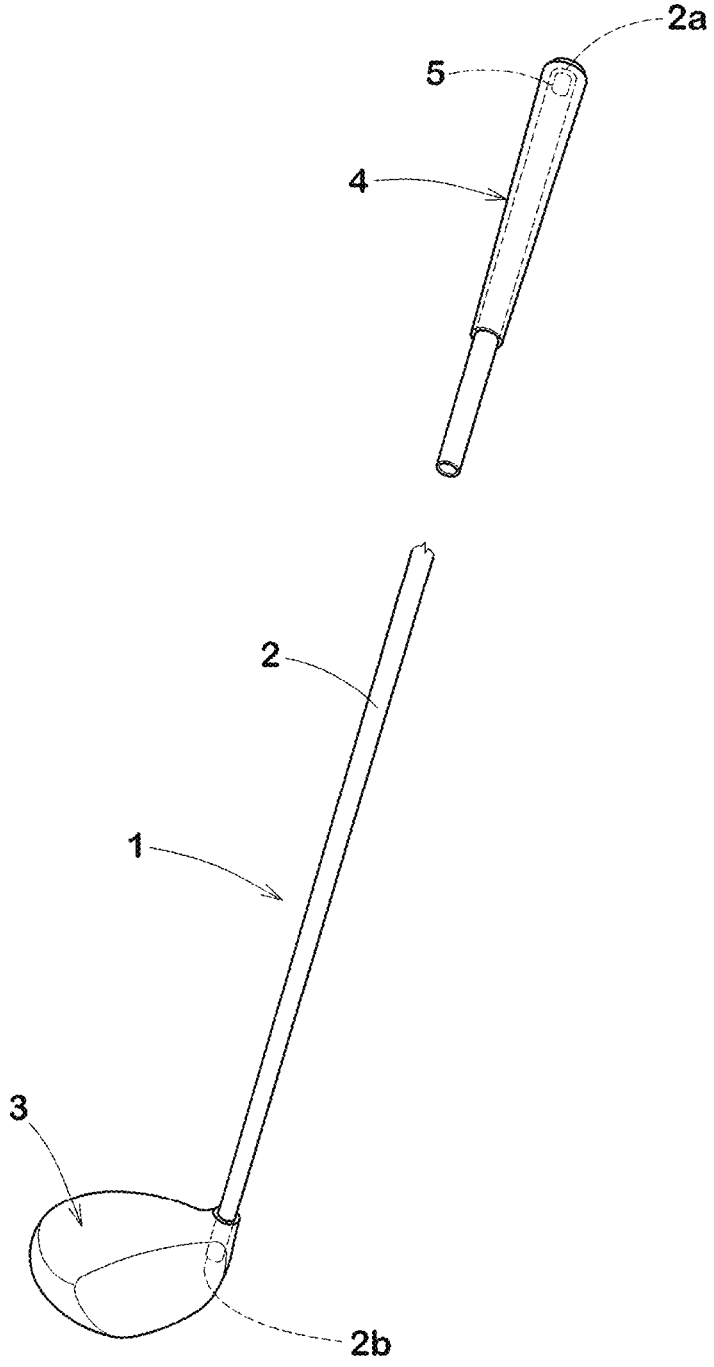
FIG. 1 is a perspective view of a golf club according to an embodiment of the disclosure.

An embodiment of the present disclosure will be explained below with reference to the accompanying drawings. Note that the same elements or portions are denoted by the same reference numerals throughout the embodiments below, and that redundant description of already described elements is omitted.

[Overall Structure of Golf Club]

FIG. 1 is a perspective view of a golf club 1 according to an embodiment of the disclosure. As illustrated in FIG. 1, the golf club 1 includes a club shaft 2, a golf club head 3, a grip 4, and a weight piece 5.

Figure 2:
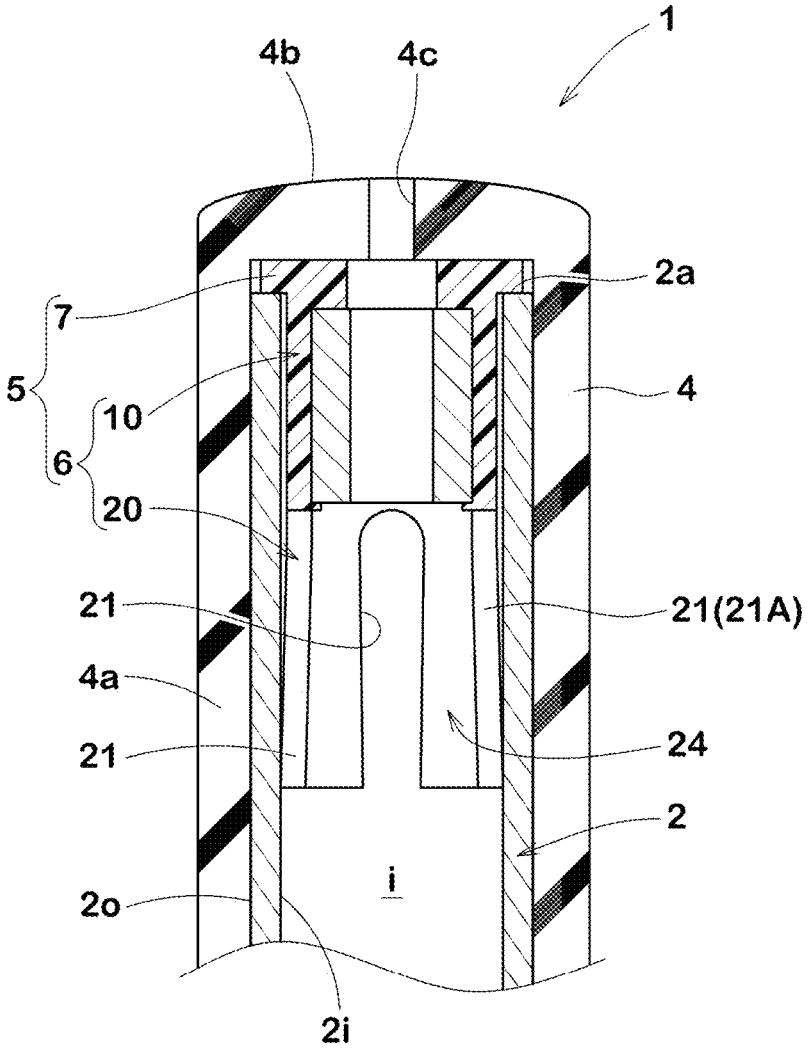
FIG. 2 is a partial cross-sectional view of the golf club on a side of the grip.

FIG. 2 is a partial cross-sectional view of the golf club 1 on the grip 4 side, wherein the cross-sectional view is a cross-section including the axial centerline of the club shaft 2. As illustrated in FIG. 1 and FIG. 2, the club shaft 2 has a tubular shape having an inner space (i) therein. More specifically, the club shaft 2, in a cross-section perpendicular to the shaft axial direction, has circular outer and inner circumferential faces 2*o* and 2*i*. Thus, the club shaft 2 has a cylindrical tubular shape. The club shaft 2, for example, may be configured by a fiber reinforced plastic or metallic material.

[Club Shaft]

The club shaft 2, in the shaft axial direction, includes a first end 2*a* and a second end 2*b* (shown in FIG. 1). In the present embodiment, the club shaft 2 has a tapered shape of the outer and inner diameters both tapering gradually from the first end 2*a* toward the second end 2*b*. In another embodiment, the club shaft 2 may have a constant outer diameter and inner diameter.

The golf club head 3, which is for striking a ball, is fixed to the second end 2*b* of the club shaft 2. The golf club head 3, for example, is configured as a wood-type head. In another embodiment, the golf club head 3 may be embodied as iron-type, hybrid-type or putter-type.

[Grip]

The grip 4 is attached to the first end 2*a* side of the club shaft 2. The grip 4, for example, includes a tubular grip main body 4*a* that golfers grip, and a grip end face 4*b* located on a one end of the grip main body 4*a*. The grip main body 4*a* has a substantially cylindrical tubular shape, more specifically, having a tapered shape tapering according to away from the grip end face 4*b*. Additionally, another end side of the grip main body 4*a* is opened (not illustrated) so that the club shaft 2 can be inserted therefrom. Note that the grip end face 4*b* is provided with a through hole 4*c* for removing air from the interior of the golf club 1 when the club shaft 2 is inserted.

Although a material of the grip 4 is not particularly limited, a rubber is preferable, for example. As the rubber, for example, natural rubber, styrene butadiene rubber, EPDM, isoprene rubber and mixtures thereof are preferred. In view of moldability of the grip 4, EPDM and styrene butadiene rubber may further be preferred.

[Weight Piece]

The weight piece 5 is installed on the first end 2*a* side of the club shaft 2. Thus, the weight piece 5 is located on an opposite side to the golf club head 3 in the shaft axial direction. Such a weight piece 5 can be helpful to provide a counterweighted golf club 1.

As illustrated in FIG. 2, the weight piece 5 according to the present embodiment includes an insertion portion 6 and an engagement portion 7.

[Insertion Portion]

The insertion portion 6 is a portion that is located in the inner space (i) of the shaft 2, and includes a first portion 10 on the first end 2*a* side and a second portion 20 on the second end 2*b* side. On the other hand, the engagement portion 7 is located outside the inner space (i) of the club shaft 2 to engage the first end 2*a* of the club shaft 1.

[First Portion]

Figure 3:
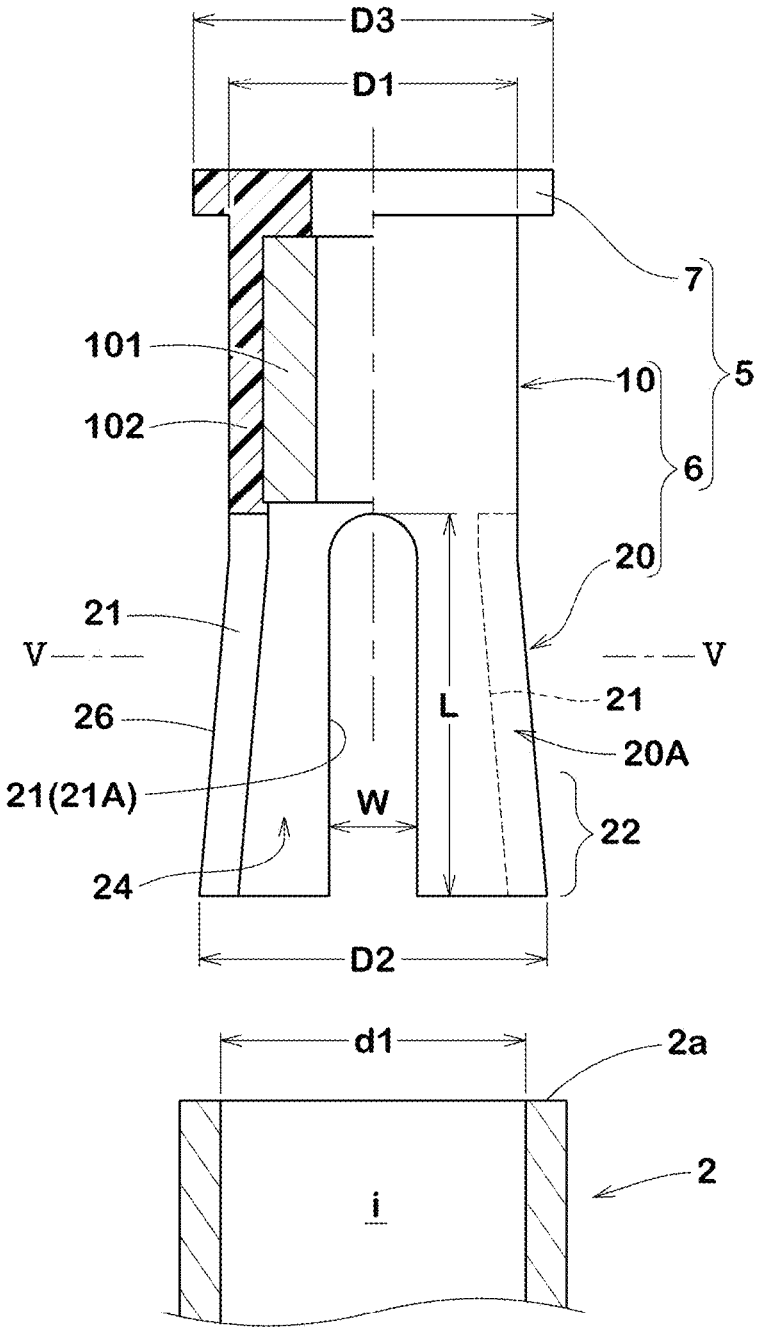
FIG. 3 is a cross-sectional view of a weight piece according to an embodiment of the disclosure.
Figure 4:
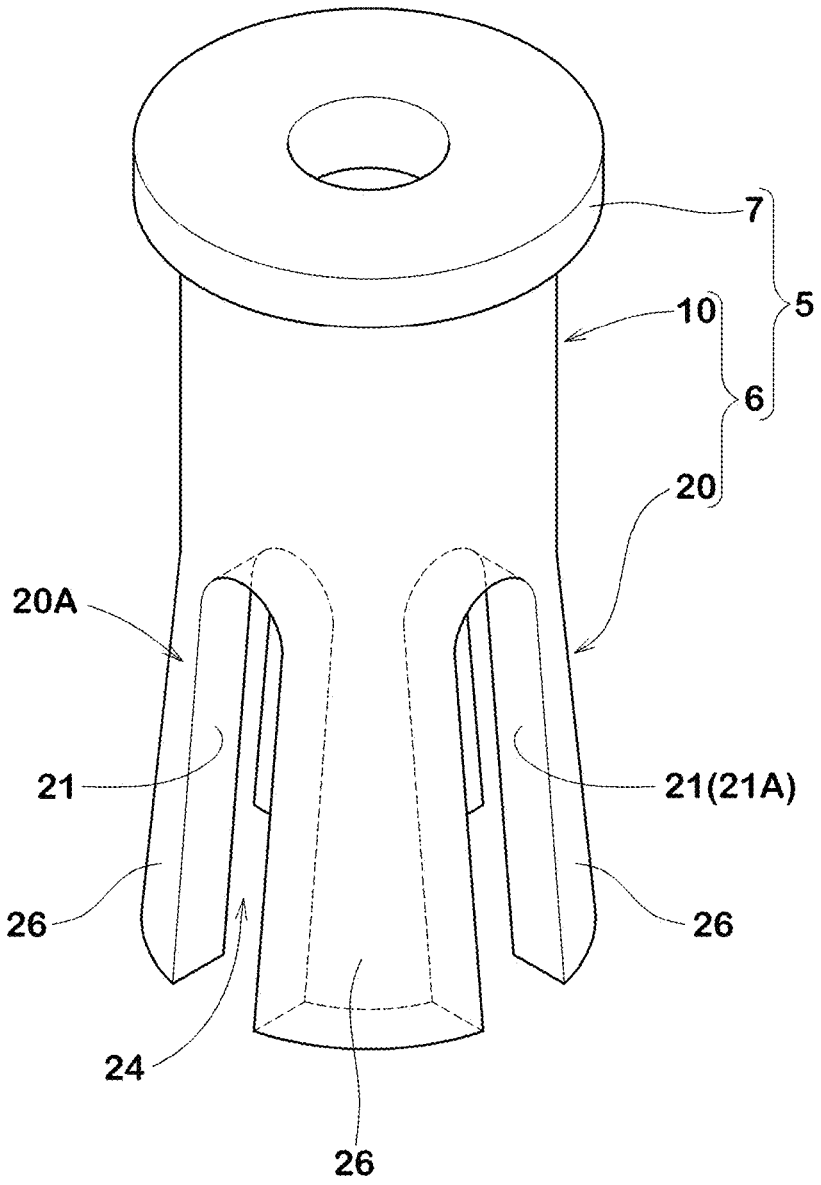
FIG. 4 is a perspective view of the weight piece according to an embodiment of the disclosure.

FIG. 3 illustrates the club shaft 2 and the weight piece 5 in the state before being placed in the club shaft 2. FIG. 4 is a perspective view of the weight piece 5 in the state before being placed in the club shaft 2. As illustrated in FIGS. 2 to 4, the first portion 10, for example, has an outer diameter D1 which is smaller than a first inner diameter d1 of the club shaft 2 at the first end 2*a* side. The first portion 10 according to the present embodiment has a columnar shape. In addition, the first portion 10 according to the present embodiment extends in the shaft axial direction with a substantially constant outer diameter D1. In another embodiment, the first portion 10 may be polygonal prismatic and the outer diameter D1 may change in the shaft axial direction.

The first portion 10, for example, includes a metal weight body 101 and an elastic body 102 made of plastic, elastomer or rubber covering the weight body 101 at least partially. The elastic body 102 according to the present embodiment, for example, is made of a plastic. The weight body 101, for example, has a columnar shape. Preferably, the weight body 101 and the elastic body 102 are integrally formed in advance by insert molding, etc., for example.

When the first portion 10 includes the above-mentioned metal weight body 101, a small volume can provide a sufficiently large weight of the weight piece 5. In addition, since the surface of the first portion 10 is formed by the elastic body 102, it is preferable in that damage to the shaft 2 can be suppressed when the shaft 2 comes into contact with the first portion 10.

[Second Portion]

The second portion 20 is located on the second end 2*b* side of the first portion 10. The second portion 20 according to the present embodiment is formed in a cylindrical body (conical cylinder body) with a hollow portion 24 on a center side in the shaft radial direction. Specifically, the second portion 20 according to the present embodiment is a cylindrical body obtained by extending the elastic body 102 of the first portion 10 to the second end 2*b* side. Thus, the second portion 20 according to the present embodiment is made of an elastic material made of plastic, elastomer or rubber.

As illustrated in FIG. 3, the second portion 20 includes a large diameter portion 22 having an outer diameter D2 larger than the first inner diameter d1 under the state before being placed in the club shaft 2. The second portion 20 according to the present embodiment, for example includes an enlarged diameter portion 20A whose outer diameter, in a state before being placed in the club shaft 2, increasing gradually toward the second end 2*b*. The large diameter portion 22 is formed on an end side of the enlarged diameter portion 20A. The enlarged diameter portion 20A, for example, forms a conical surface.

In addition, the second portion 20 is provided with at least one rigidity-lowered portion 21. As the rigidity-lowered portion 21, for example, one or more slits 21A may be adopted. The slits 21A can locally reduce stiffness of the second portion 20 by cutting out the same. In some preferred embodiments, the second portion 20 is provided with a plurality of slits 21A extending in the shaft axial direction. By providing a plurality of slits 21A, the second portion 20 is divided into a plurality of claw pieces 26 that extends in the shaft axial direction and is elastically deformable.

The second portion 20 as described above can be elastically deformed so that its outer diameter (the outer diameter D2 of the large diameter portion 22) becomes smaller when receiving an external force. For example, by pushing the claw pieces 26 toward the center side in the shaft radial direction with fingers, each claw piece 26 is elastically bent and deformed from the vicinity of its root side. As a result, the outer diameter D2 of the large diameter portion 22 can be small easily.

Although not particularly limited, in order to easily deform the claw pieces 26, a length L along the shaft axal direction of the slits 21A, for example, is preferably equal to or more than 3.0 mm, more preferably equal to or more than 4.0 mm, still further preferably equal to or more than 5.0 mm. From the same viewpoint, a width W (the dimension orthogonal to the length L) of the slits 21A, for example, is preferably equal to or more than 0.5 mm, more preferably equal to or more than 1.0 mm, still further preferably equal to or more than 1.5 mm.

[Engagement Portion]

The engagement portion 7 engages the first end 2*a* of the shaft 2, and thus the engagement portion 7 cannot enter the inner space (i) of the club shaft 2. This can regulate the insertion position of the weight piece 5 into the club shaft 2 and stabilize the position of the weight piece 5. The engagement portion 7 according to the present embodiment is formed into a flange having an outer diameter D3 larger than the first inner diameter d1 of the club shaft 2. The engagement portion 7 can take various forms as long as it has a shape that engages with the first end 2*a* of the club shaft 2.

[Process of Inserting Weight Piece into Shaft]

The process of inserting the weight piece 5 into the inner space (i) of the club shaft 2 is performed by the following procedure, for example. First, give an external force to the second portion 20 of the weight piece 5 by, for example, jig, fingers, or other means to deform the second portion 20 elastically so that the outer diameter of the second portion 20 becomes smaller than the first inner diameter d1 of the club shaft 2. Next, in this state, the second portion 20 of the weight piece 5 is pushed into the inner space (i) from the first end 2*a* side of the club shaft 2. This allows the insertion portion 6 of the weight piece 5 to be easily inserted into the inner space (i) of the club shaft 2. Further, as the insertion of the insertion portion 6 into the shaft 2 progresses, the engagement portion 7 contacts the first end 2*a* of the club shaft 2 and the insertion position of the weight piece 5 into the shaft 2 is restricted.

Furthermore, when the insertion portion 6 is completely inserted into the inner space (i) of the club shaft 2, the second portion 20 is released from an external force and tries to elastically restore its original shape. However, since the outer diameter D2 of the large diameter portion 22 is originally larger than the first inner diameter d1 of the club shaft 2, the second portion 20 is placed inside the inner space (i) of the club shaft 2 in an elastically deformed state (not completely restored to its original shape). Thus, the large diameter portion 22 of the second portion 20 is expanded by its elastic restoring force, and at least a part of it contacts with the inner peripheral surface 2*i* of the shaft 2. Therefore, contact friction occurs between the weight piece 5 and the inner peripheral surface 2*i* of the shaft 2 so that the position of the weight piece 5 can be stable.

As described above, the golf club 1 according to the present disclosure can suppress the misalignment and rattling noise of the weight piece 5 while facilitating the process of inserting the weight piece 5 into the club shaft 2.

By the way, the first inner diameter d1 of the shaft 2 is generally different for each type of golf club 1. In some preferred embodiments, the outer diameter D3 of the engagement portion 7 and the outer diameter D2 of the large diameter portion 22 of the second portion 20 may be formed larger than the first inner diameter d1 of some types of shafts 2, and the outer diameter D1 of the first portion 10 may be formed smaller than the first inner diameter d1 of some types of shafts 2. In this case, the weight piece 5 can be attached to various types of shafts 2 with different first inner diameters d1, which can improve the versatility of the weight piece 5.

Next, some more preferred embodiments of the present invention will be described.

[Interval of Rigidity-Lowered Portion (FIG. 5)]

Figure 5:
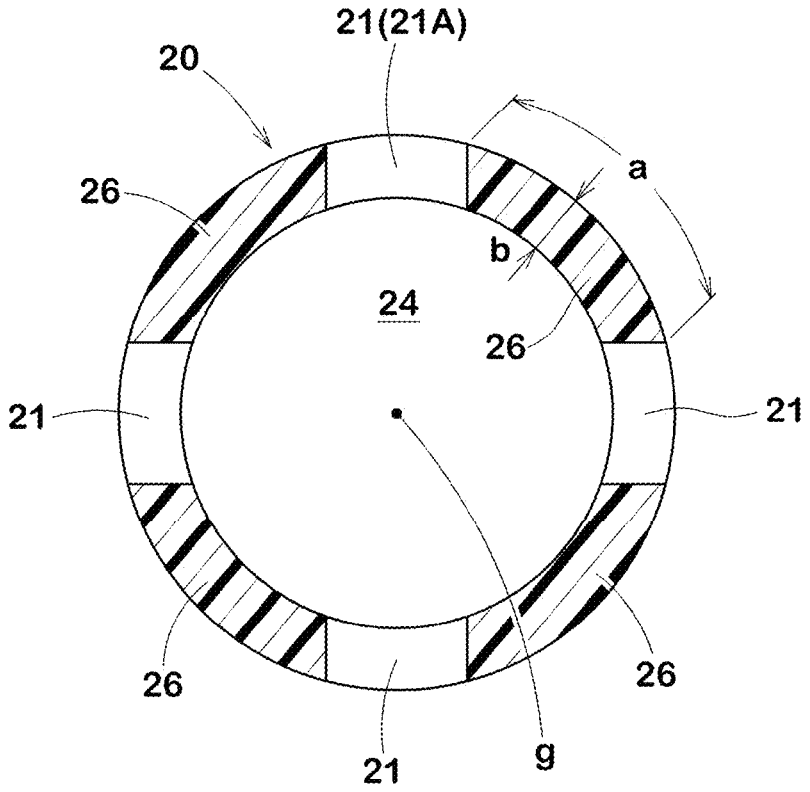
FIG. 5 is a cross-sectional view taken along the lines V-V of FIG. 3.

FIG. 5 illustrates a cross-sectional view taken along the line V-V of FIG. 3. As illustrated in FIG. 5, the rigidity-lowered portion 21 (the slits 21A) may be formed at an equal interval in the shaft circumferential direction of the second portion 20. According to such an embodiment, the flexural rigidity of each claw piece 26 of the second portion 20 may be made uniform, and the elastic restoring force of each claw piece 26 may work on the inner peripheral surface 2*i* of the club shaft 2 in a well-balanced manner in the shaft circumferential direction. Thus, the weight piece 5 according to the present embodiment can be held more stably in the inner space (i) of the club shaft 2.

In FIG. 5, as such an example, four slits 21A each having the same shape are arranged at a 90-degree interval in the shaft circumferential direction. Further, when the weight piece 5 is attached to the inner space (i) of the club shaft 2, it is preferable that the center of gravity g of the second portion 20 (shown for convenience in FIG. 5) is formed on the center line of the club shaft. As a result, the above effect can be obtained more reliably.

In addition, as illustrated in FIG. 5, a cross-sectional shape of each claw piece 26 perpendicular to the shaft axial direction may decrease toward the second end 2*b*. Specifically, the circumferential length (a) and/or the thickness (b) in the shaft radial direction of each claw piece 26 may be formed so as to decrease continuously or stepwisely toward the second end 2*b* of the club shaft 2. In such an embodiment, the center of gravity of the second portion 20 may be located on the first end 2*a* side in the shaft axial direction, so that the counterbalance effect can further be enhanced.

[Other Embodiments of Weight Piece (FIG. 6)]

Figure 6:
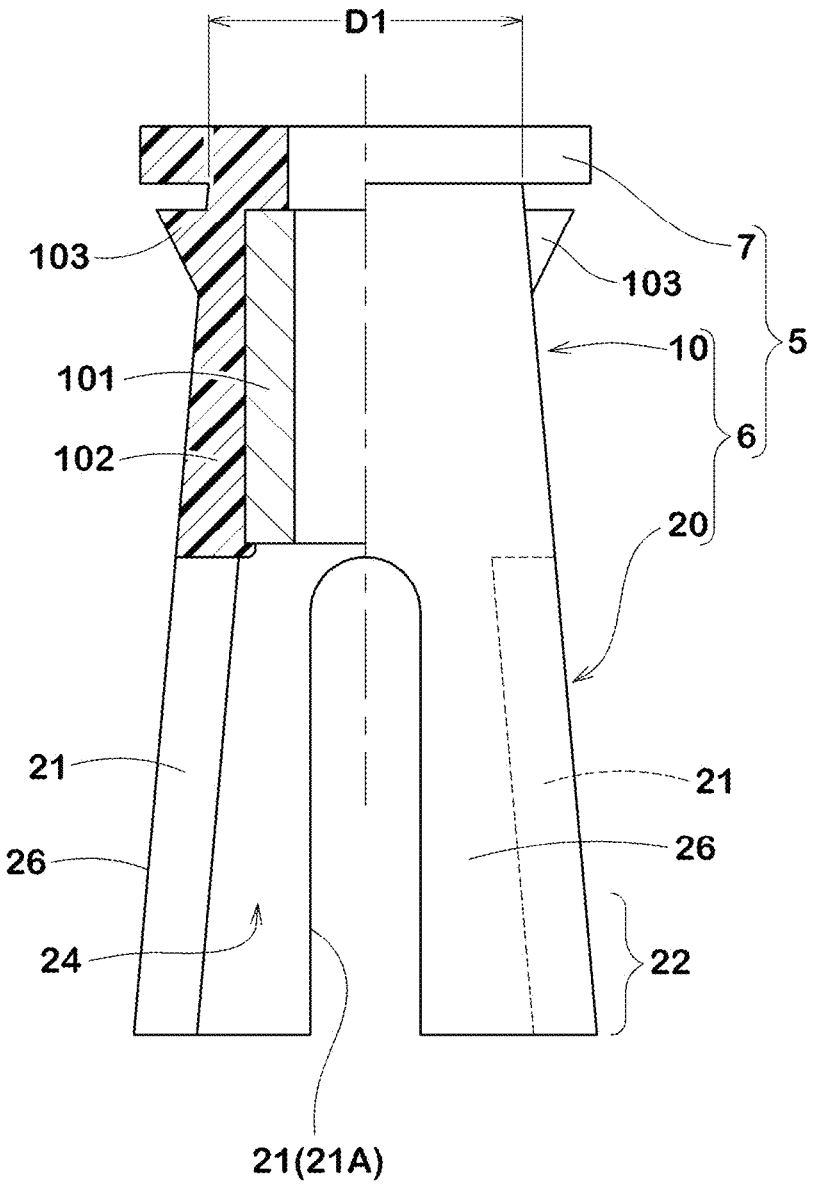
FIG. 6 is a cross-sectional view of the weight piece according to another embodiment.

FIG. 6 illustrates a cross-sectional view of the weight piece 5 according to another embodiment. The weight piece 5 differs from FIG. 3 in that the outer diameter D1 of the first portion 10 increases continuously toward the second end 2*b*. Thus, the first portion 10 has a conical outer surface. In addition, the weight piece 5 is formed so that the conical outer surface is continuous from the first portion 10 to the second portion 20. Such a weight piece 5 can be installed on various shafts with different first inner diameters d1 and be highly versatile.

[Yet Another Embodiment of Weight Piece (FIG. 6)]

As illustrated in FIG. 6, the first portion 10 of the weight piece 5 include an outer surface being provided with at least one protrusion 103 protruding in the shaft radial direction which is capable of contacting with inner peripheral surface 2*i* of the club shaft 2. The protrusion 103, for example, has a protrusion height increasing continuously toward the engagement portion 7. This allows the protrusion 103 to be easily inserted into the club shaft 2. Preferably, a plurality of protrusions 103 may be provided at an equal interval in the shaft circumferential direction.

In the weight piece 5 according to this embodiment, when the first portion 10 is placed in the inner space (i) of the club shaft 2, the protrusions 103 and/or the inner peripheral surface 2*i* of the club shaft 2 is deformed, so that a high contact pressure may be locally obtained therebetween. Thus, the weight piece 5 can be more securely fixed inside the club shaft 2. Note that the protrusions 103 can be applied to the weight piece 5 in the shape of FIG. 3.

[Yet Another Embodiment of Weight Piece (FIG. 7)]

Figure 7:
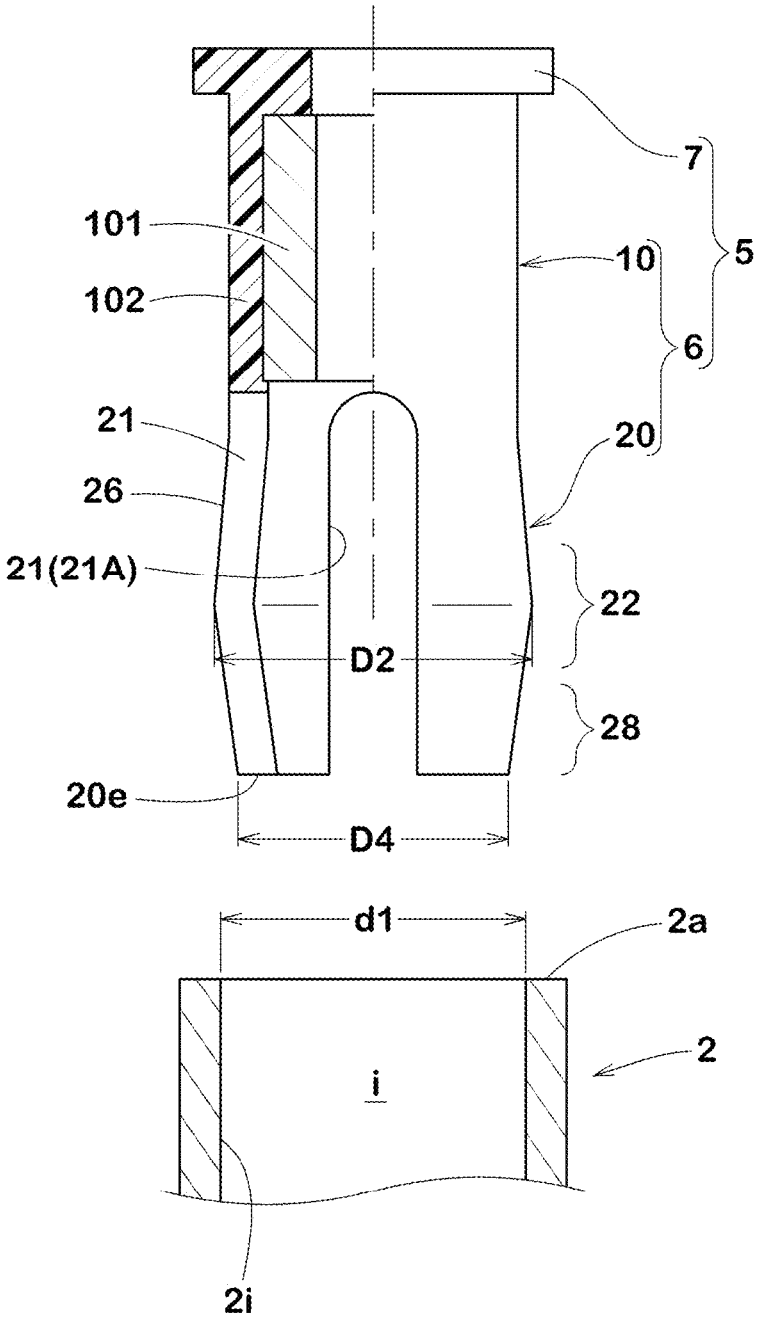
FIG. 7 is a cross-sectional view of the weight piece according to yet another embodiment.

FIG. 7 illustrates a cross-sectional view of the weight piece 5 according to yet another embodiment. the weight piece 5 differs from FIG. 3 in that the second portion 20 includes a small diameter portion 28. The small diameter portion 28 is provided on an end 20*e* of the second portion 20 on the second end 2*b* side. Further, in a state of the weight piece 5 before being placed in the club shaft 2, an outer diameter D4 of the small diameter portion 28 is smaller than the first inner diameter d1 of the club shaft 2.

In some preferred embodiments, the small diameter portion 28 tapers so that the outer diameter continuously decreases toward the second end 2*b* side. In addition, the slits 21A are formed from the large diameter portion 22 to the small diameter portion 28, for example.

According to the weight piece 5 shown in FIG. 7, it may be easier to insert the weight piece 5 into the club shaft 2, and the productivity of golf club 1 can be improved. That is, since the weight piece 5 has the end 20*e* of the second portion 20 with the small diameter portion 28 described above, it is not necessary to give an external force to the second portion 20 in advance to reduce its outer diameter when inserting the weight piece 5 into the club shaft 2. For example, when inserting the small diameter portion 28 into the inner space (i) of the club shaft 2, the outer peripheral surface of the large diameter portion 22 comes into contact with the inner peripheral surface 2*i* of the club shaft 2, and receives an inward force in the shaft radial direction from the inner peripheral surface 2*i*. This allows the second portion 20 to be easily inserted into the inner space (i) of the club shaft 2 while gradually shrinking its outer diameter.

[Yet Another Embodiment of Weight Piece (FIG. 8)]

Figure 8:
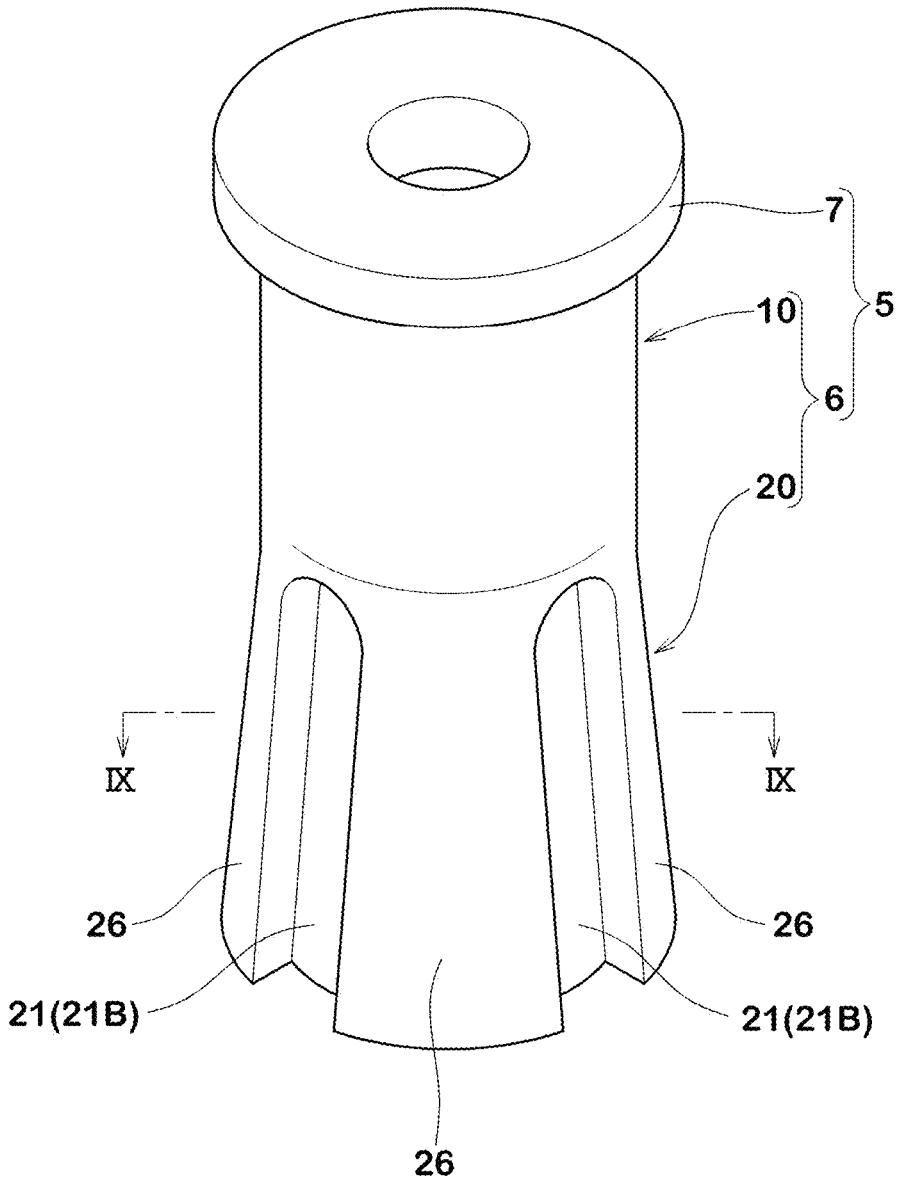
FIG. 8 is a perspective view of the weight piece according to yet another embodiment.
Figure 9:
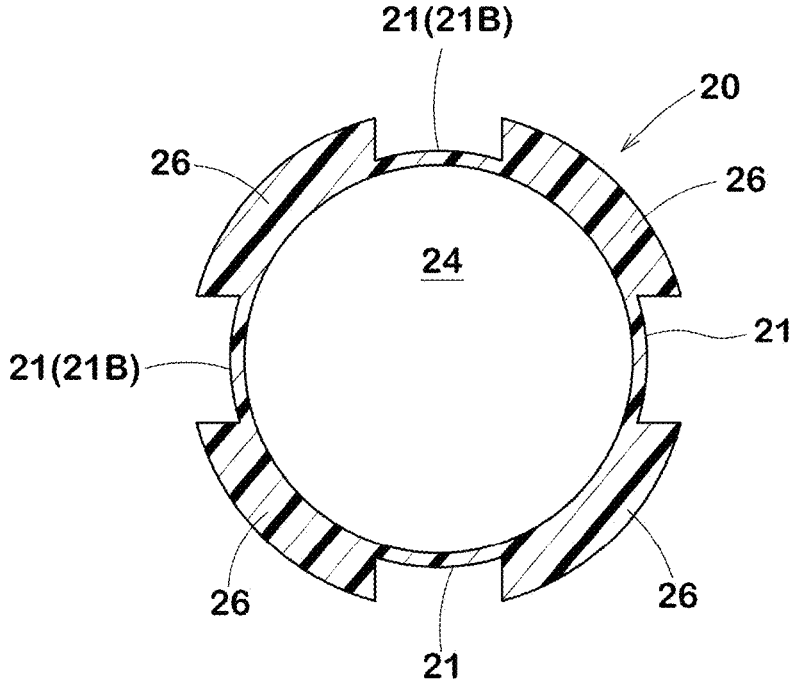
FIG. 9 is a cross-sectional view taken along the lines IX-IX of FIG. 8.

FIG. 8 illustrates a perspective view of the weight piece 5 according to yet another embodiment. FIG. 9 is a cross-sectional view taken along the lines IX-IX of FIG. 8. As illustrated in FIG. 8 and FIG. 9, in the weight piece 5 according to this embodiment, the rigidity-lowered portions 21 of the second portion 20 are formed into thin-walled portions 21B (instead of the slits 21A). The thin-walled portions 21B, for example, connect the adjacent claw pieces 26 and 26 with a wall thickness smaller than that of the claw pieces 26, and extend in the shaft axial direction. In this embodiment, the thin-walled portions 21B have a thickness in the shaft radial direction equal to or less than 50% of the wall thickness of the claw pieces 26, for example.

The thin-walled portions 21B as described above can easily deformed itself when an external force is applied. Thus, in this embodiment as well, when an external force is given to the second portion 20, the outer diameter of the large diameter portion 22 can be elastically deformed to be small. Further, when the rigidity-lowered portions 21 are configured as the thin-walled portions 21B, it may be possible to generate a larger elastic restoring force in each of the claw pieces 26 than in the case of the slits 21A. Thus, the position of the weight piece 5 can be more stable.

In this embodiment, the thin-walled portions 21B connect the claw pieces 26 at a position recessed from the radially outer surface of the shaft of the second portion 20. Alternatively, the thin-walled portions 21B may be provided in a recessed position from the radially inner surface of the shaft of the second portion 20.

Figure 10:
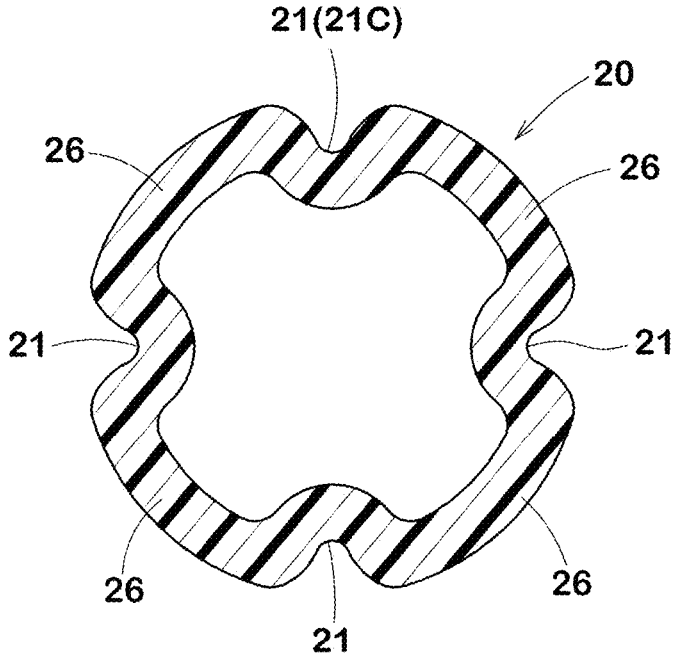
FIG. 10 is a cross-sectional view of a second portion of the weight piece according to yet another embodiment.

FIG. 10 illustrates a cross-sectional view (equivalent to IX-IX line cross section of FIG. 8) of the second portion 20 of the weight piece 5 according to yet another embodiment. As illustrated in FIG. 10, in this weight piece 5, instead of the slits 21A, the rigidity-lowered portions 21 of the second portion 20 are formed into grooves 21C. The grooves 21C are recessed in the shaft radial direction between the adjacent claw pieces 26 and 26 and extend in the shaft axial direction. In addition, the grooves 21C, for example, connect the adjacent claw pieces 26 with a wall thickness equal to or less than the wall thickness of the claw pieces 26.

Therefore, even in this embodiment, when an external force is applied to the second portion 20, the grooves 21C are locally deformed, and the outer diameter of the large diameter portion 22 can be elastically deformed to a small extent. Further, when the rigidity-lowered portions 21 are configured as the grooves 21C, each claw piece 26 can generate a larger elastic restoring force than the case of the slits 21A. Thus, the position of the weight piece 5 can be more stable.

As the rigidity-lowered portions 21, it is noted that the thin-walled portions 21B or the grooves 21C may be used together with the slits 21A.

While the particularly preferable embodiments in accordance with the present disclosure have been described in detail, the present disclosure is not limited to the illustrated embodiments, but can be modified and carried out in various aspects within the scope of the disclosure.

The following clauses are disclosed regarding the above-described embodiments.

Clause 1

A golf club comprising:

a tubular club shaft having a first end with a first inner diameter, a second end, and an inner peripheral surface defining an inner space of the club shaft;

a weight piece installed on a first end side of the club shaft; and a golf club head mounted on a second end side of the club shaft, wherein the weight piece comprises an insertion portion located in the inner space of the club shaft, and an engagement portion located outside the inner space of the club shaft to engage the first end of the club shaft, the insertion portion comprises a first portion on a first end side, and a second portion on a second end side, the first portion has an outer diameter smaller than the first inner diameter, the second portion comprises a large diameter portion having an outer diameter larger than the first inner diameter in a state before being placed in the club shaft, and at least one rigidity-lowered portion that elastically deforms the second portion so that the outer diameter of the large diameter portion becomes smaller when receiving an external force, and the second portion is placed in the inner space in an elastically deformed state so that the large diameter portion is at least partially in contact with the inner peripheral surface of the club shaft due to its elastic restoring force.

Clause 2

The golf club according to clause 1, wherein the at least one rigidity-lowered portion comprises at least one slit.

Clause 3

The golf club according to clause 1 or 2, wherein the second portion has a cylindrical body with a hollow portion on a center side in a shaft radial direction, and the at least one rigidity-lowered portion extends on the cylindrical body in a shaft axial direction.

Clause 4

The golf club according to any one of clauses 1 to 3, wherein the at least one rigidity-lowered portion comprises a plurality of rigidity-lowered portions.

Clause 5

The golf club according to any one of clauses 1 to 4, wherein the at least one rigidity-lowered portion comprises a plurality of rigidity-lowered portion formed at an equal interval in a shaft circumferential direction of the second portion.

Clause 6

The golf club according to any one of clauses 1 to 5, wherein the second portion comprises an enlarged diameter portion whose outer diameter, in a state before being placed in the club shaft, increasing toward the second end.

Clause 7

The golf club according to any one of clauses 1 to 6, wherein the second portion comprises a small diameter portion whose outer diameter at an end on the second end side, in a state before being placed on the club shaft, is smaller than the first inner diameter.

Clause 8

The golf club according to clause 2, wherein the second portion is divided into a plurality of deformable claw pieces extending in a shaft axial direction by the at least one slit, and a cross-sectional shape of each claw piece perpendicular to the shaft axial direction decreases toward the second end.

Clause 9

The golf club according to any one of clauses 1 to 8, wherein the first portion comprises an outer surface being provided with at least one protrusion protruding in a shaft radial direction to contact with inner peripheral surface of the club shaft.

Clause 10

The golf club according to clause 9, wherein the at least one protrusion has a protrusion height increasing toward the engagement portion.

Clause 11

The golf club according to any one of clauses 1 to 10, wherein the first portion comprises a metal weight body and an elastic body made of resin, elastomer or rubber covering the weight body at least partially.

Clause 12

The golf club according to any one of clauses 1 to 11, wherein the at least one rigidity-lowered portion comprises a thin-walled portion or groove.

Clause 13

A weight piece for golf club having a tubular club shaft having a first end with a first inner diameter, a second end, and an inner surface therein, the weight piece adapted to be installed on a first end side of the club shaft, the weight piece comprising:

an insertion portion to be located in the inner space of the club shaft, and an engagement portion to be located outside the inner space of the club shaft to engage the first end of the club shaft, wherein the insertion portion comprises a first portion on a first end side, and a second portion on a second end side, and the second portion comprises at least one rigidity-lowered portion that elastically deforms the second portion so that the outer diameter of the large diameter portion becomes smaller when receiving an external force.

Clause 14

The weight piece for golf club according to clause 13, wherein the at least one rigidity-lowered portion comprises at least one slit.

Clause 15

The weight piece for golf club according to clause 13 or 14, wherein the at least one rigidity-lowered portion comprises a thin-walled portion or groove.

Clause 16

The weight piece for golf club according to any one of clauses 13 to 15, wherein the at least one rigidity-lowered portion comprises a plurality of rigidity-lowered portions.

Clause 17

The weight piece for golf club according to any one of clauses 13 to 16, wherein the at least one rigidity-lowered portion comprises a plurality of rigidity-lowered portion formed at an equal interval in a shaft circumferential direction of the second portion.

Clause 18

The weight piece for golf club according to any one of clauses 13 to 17, wherein the second portion comprises an enlarged diameter portion whose outer diameter increasing toward the second end.

Clause 19

The weight piece for golf club according to any one of clauses 13 to 18, wherein the second portion comprises a small diameter portion whose outer diameter at an end on a second end side is smaller than the first inner diameter of the club shaft.

Clause 20

The weight piece for golf club according to any one of clauses 13 to 19, wherein the second portion is divided into a plurality of deformable claw pieces extending in a shaft axial direction by the at least one slit, and a cross-sectional shape of each claw piece perpendicular to a shaft axial direction decreases toward the second end.

The invention claimed is:

1. A golf club comprising:

a tubular club shaft having a first end with a first inner diameter, a second end and an inner peripheral surface defining an inner space of the club shaft;

a weight piece installed on a first end side of the club shaft; and a golf club head mounted on a second end side of the club shaft, wherein the weight piece comprises:

a metal weight body, and an elastic body made of plastic, elastomer or rubber, the elastic body comprises:

an insertion portion located in the inner space of the club shaft, and an engagement portion located outside the inner space of the club shaft to engage the first end of the club shaft, and having an outer diameter larger than the first inner diameter at the first end so as not to enter into the inner space, the insertion portion comprises:

a first portion in which the metal weight body is embedded, the outer diameter of the first portion is smaller than the first inner diameter, and a second portion extending from the first portion to a free end, an outer diameter of the second portion continuously increases from the first portion towards the free end of the second portion, and reaches a maximum diameter, and then continuously decreases to the free end of the second portion, the second portion is provided with slits each extending in the shaft axial direction so that the second portion is circumferentially divided into claw pieces each extending in a shaft axial direction, the second portion divided into the claw pieces includes a large diameter portion in which an outer diameter of the large diameter portion is larger than the first inner diameter in a state before being placed in the inner space of the club shaft, and a small diameter portion adjacent the free end in which an outer diameter of the small diameter portion is smaller than the first inner diameter in the state before being placed in the inner space of the club shaft, and wherein said maximum diameter of the second portion occurs in the large diameter portion, wherein the claw pieces are elastically deformable so that the outer diameter of the large diameter portion becomes smaller when receiving an external force, and wherein the second portion is configured to be placed in the inner space in an elastically deformed state of the claw pieces so that the large diameter portion is at least partially in contact with the inner peripheral surface of the club shaft due to an elastic restoring force of the claw pieces.

2. The golf club according to claim 1, wherein the weight piece has a hollow penetrating through the weight piece in the shaft axial direction.

3. The golf club according to claim 2, wherein the slits each extend from the outer surface of the second portion to the hollow to open to the hollow.

4. The golf club according to claim 3, wherein the slits are formed at equal intervals in a circumferential direction.

5. The golf club according to claim 1, wherein the slits are formed at equal intervals in a circumferential direction.

6. The golf club according to claim 1, wherein the outer surface of the first portion is provided with at least one protrusion protruding so as to contact with the inner peripheral surface of the club shaft.

7. The golf club according to claim 6, wherein the amount of protruding of the at least one protrusion is increased toward the engagement portion.

8. A weight piece for a golf club having a tubular club shaft having a first end with a first inner diameter, a second end, and an inner peripheral surface defining an inner space of the club shaft, the weight piece adapted to be installed on a first end side of the club shaft, wherein the weight piece comprises:

a metal weight body, and an elastic body made of plastic, elastomer or rubber, the elastic body comprises:

an insertion portion to be located in the inner space of the club shaft, and an engagement portion to be located outside the inner space of the club shaft to engage the first end of the club shaft, and having an outer diameter larger than the first inner diameter at the first end of the golf club shaft so as not to enter into the inner space, the insertion portion comprises:

a first portion in which the metal weight body is embedded, the outer diameter of the first portion is smaller than the first inner diameter, and a second portion extending from the first portion to a free end, an outer diameter of the second portion continuously increases from the first portion towards the free end of the second portion, and reaches a maximum diameter, and then continuously decreases to the free end of the second portion, the second portion is provided with slits each extending in the shaft axial direction so that the second portion is circumferentially divided into claw pieces each extending in a shaft axial direction, the second portion divided into the claw pieces includes a large diameter portion in which an outer diameter of the large diameter portion is larger than the first inner diameter in a state before being placed in the inner space of the club shaft, and a small diameter portion adjacent the free end in which an outer diameter of the small diameter portion is smaller than the first inner diameter in the state before being placed in the inner space of the club shaft, and wherein said maximum diameter of the second portion occurs in the large diameter portion, wherein the claw pieces are elastically deformable so that the outer diameter of the large diameter portion becomes smaller when receiving an external force so as to allow the second portion to be placed in the inner space in an elastically deformed state of the claw pieces, and to allow the large diameter portion to be at least partially in contact with the inner peripheral surface of the club shaft due to the elastic restoring force of the claw pieces.

9. The weight piece for golf club according to claim 8, wherein the slits are formed at equal intervals in a circumferential direction.

10. The weight piece for golf club according to claim 8, wherein the weight piece has a hollow penetrating through the weight piece in the shaft axial direction.

11. The weight piece for golf club according to claim 10, wherein the slits each extend from the outer surface of the second portion to the hollow to open to the hollow.

12. The weight piece for golf club according to claim 11, wherein the slits are formed at equal intervals in a circumferential direction.

13. The weight piece for golf club according to claim 8, wherein the outer surface of the first portion is provided with at least one protrusion protruding so as to contact with the inner peripheral surface of the club shaft.

14. The weight piece for golf club according to claim 13, wherein the amount of protruding of the at least one protrusion is increased toward the engagement portion.

* * * * *